United States Patent [19]

Harris

[11] Patent Number: 5,016,287

[45] Date of Patent: May 21, 1991

[54] EVAPORATIVE COOLED CLOTH HOOD

[76] Inventor: John R. Harris, 8541 N. 31st Ave., Phoenix, Ariz. 85051

[21] Appl. No.: 573,860

[22] Filed: Aug. 28, 1990

Related U.S. Application Data

[63] Continuation of Ser. No. 398,464, Aug. 25, 1989.

[51] Int. Cl.[5] ..... A42B 1/04

[52] U.S. Cl. ..... 2/202; 2/203; 2/205

[58] Field of Search ..... 2/202, 203, 204, 205, 2/171, 171.1, 171.2, 171.4, 171.5, 174, 198, 200

[56] References Cited

U.S. PATENT DOCUMENTS

| | | | |
|---|---|---|---|
| 160,452 | 3/1875 | Mendel | 2/203 |
| D. 189,233 | 11/1960 | Gardner | 2/205 |
| 276,720 | 5/1883 | Seiler | 2/203 |
| 787,945 | 4/1905 | Rautenberg | 2/205 |
| 1,485,392 | 3/1924 | Helek | 2/202 |
| 2,160,567 | 5/1939 | Sterne | 2/171 |
| 2,272,959 | 2/1942 | Van Wormer | 2/205 |
| 2,363,198 | 11/1944 | Paull | 2/198 |
| 2,446,530 | 8/1948 | DeGrazia | 2/171.5 |
| 3,943,575 | 3/1976 | Bolker | 2/205 |
| 4,190,907 | 3/1980 | Cruickshank | 2/202 |

FOREIGN PATENT DOCUMENTS

| | | | |
|---|---|---|---|
| 420634 | 2/1911 | France | 2/203 |
| 94689 | 8/1959 | Norway | 2/202 |
| 175594 | 6/1961 | Sweden | 2/202 |
| 185405 | 7/1936 | Switzerland | 2/205 |
| 1302346 | 1/1973 | United Kingdom | 2/174 |
| 1593360 | 7/1981 | United Kingdom | 2/202 |

*Primary Examiner*—Werner H. Schroeder
*Assistant Examiner*—Diana L. Biefeld
*Attorney, Agent, or Firm*—Warren F. B. Lindsley

[57] ABSTRACT

An evaporative cooled cloth hood for use in high temperature atmospheres comprising a plurality of parts which when secured together fit over the head, forehead and chest of the user for cooling purposes.

2 Claims, 1 Drawing Sheet

EVAPORATIVE COOLED CLOTH HOOD

This application is a continuation of applicant's U.S. Design application, Ser. No. 07/398,464 filed Aug. 25, 1989 and entitled Evaporative Hood For Use In High Temperature Atmospheres.

BACKGROUND OF THE INVENTION

This invention relates to evaporative hoods for use in high temperature atmospheres. More particularly, the invention relates to a cloth hood of a towel like material which is intended to be worn by a worker or exerciser when exposed to heat and/or the rays of the sun for absorbing perspiration.

This evaporative cooled hood is designed to at least partially eliminate the effects of heat and thereby enable a user to continue working or playing more comfortably in a high temperature atmosphere.

This hood when damp facilitates the normal human evaporative process by rapidly reducing body temperature in the neck and head areas thereby extending the temperature comfort zone of the wearer thereby reducing heat stress related problems.

The disclosed and claimed hood is particularly useful for firefighters not only to control the summer heat during a fire fighting activity outside of a burning building but also in a burning building, after the fire, when the temperature remains for a considerable time above atmospheric temperature. This is particularly true when the firefighter is wearing safety equipment, turnout coats, bunker pants and the like.

Outside construction workers as well as exercisers need such a hood to not only protect them from the rays of the sun but also possible injury from loss of control due to the effects of heat stress.

DESCRIPTION OF THE PRIOR ART

No pertinent prior art is known.

SUMMARY OF THE INVENTION

In accordance with the invention claimed, a water cooled evaporative cloth hood is disclosed and claimed which facilitates the human body evaporative process by rapidly reducing the temperature of the wearer in the head and neck area thereby extending the comfort zone of the wearer.

It is, therefore, one object of this invention to provide a new and improved water cooled evaporative cloth hood.

Another object of this invention is to provide a water cooled cloth hood which protects the head and neck region of a user from heat and the rays of the sun.

A further object of this invention is to provide a new and improved water cooled cloth hood for reducing heat stress which may be worn under a hat or protective helmet.

A still further object of this invention is to provide an evaporative cooled cloth hood which may be easily stored in a fireman's turnout coat or on fire apparatus for easy access.

A still further object of this invention is to provide an evaporative cooled cloth hood which is safe to use, effective, durable and easily affordable by all who may need it such as:

Roofers
Construction Workers
Street and Highway Maintenance Workers
Landscapers
Painters
Surveyors
Firefighters, City and Forest Service
Personnel
Football Players
Bicyclists
Hikers Further object and advantages of this invention will become apparent as the following description proceeds, and the features of novelty which characterize the invention will be pointed out with particularity in the claims annexed to and forming a part of this specification.

BRIEF DESCRIPTION OF THE DRAWING

The present invention may be more readily described by reference to the accompanying drawing, in which.

DESCRIPTION OF THE PREFERRED EMBODIMENT

Figure 1:
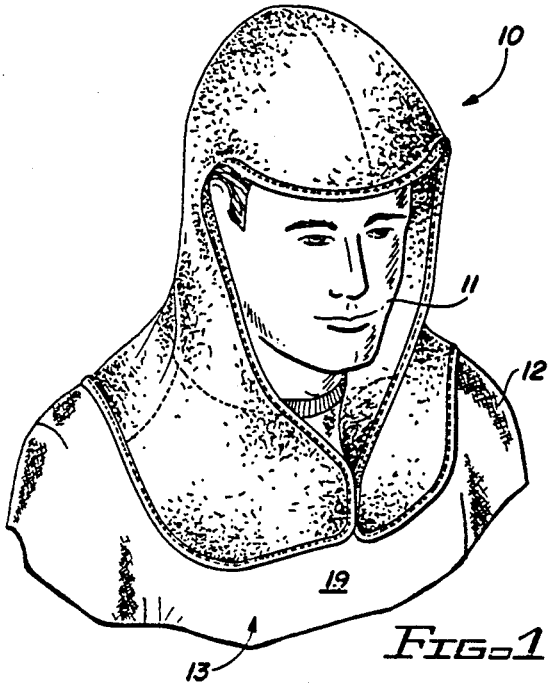
FIG. 1 is a perspective front view of an evaporative cooled cloth hood in place on a wearer.
Figure 4:
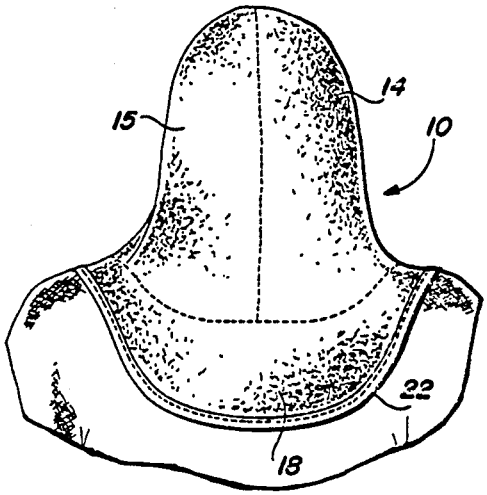
FIG. 4 is a rear view of FIG. 1.
Figure 2:
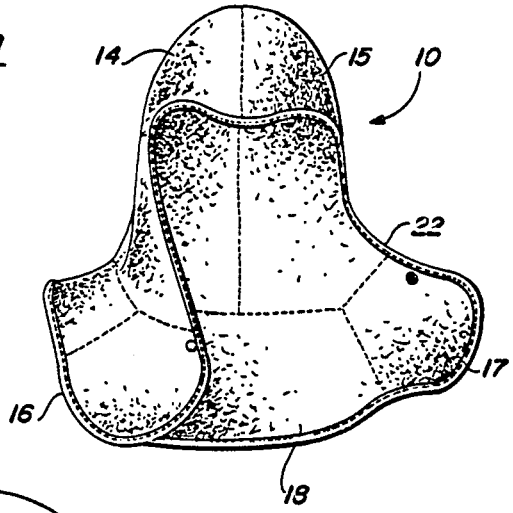
FIG. 2 is a perspective front view of the evaporative cooled cloth hood shown in FIG. 1 off of the head of a wearer.
Figure 3:
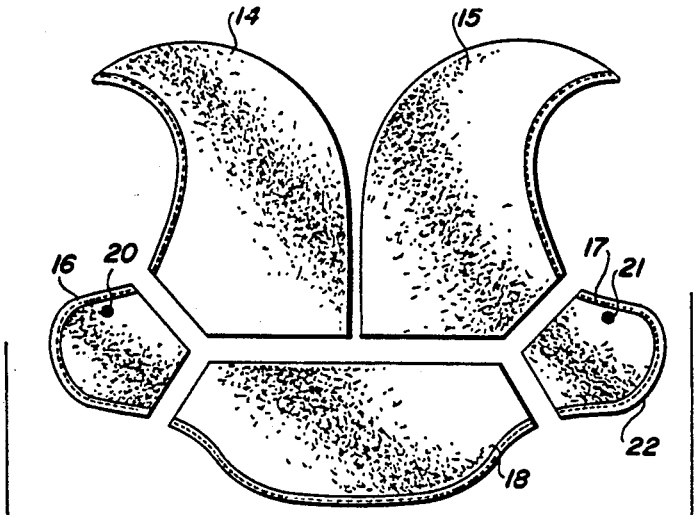
FIG. 3 is pattern of the parts of the hood shown in FIGS. 1 and 2 separated along the dash lines shown.

Referring more particularly to the drawing by characters of references, FIGS. 1 and 4 disclose an evaporative cooled cloth hood 10 mounted over the head 11 and shoulders 12 of a user or wearer 13. As shown in FIGS. 2 and 3, the cloth hood comprises a plurality of parts 14-18 which when stitched or sewn together along their edges, as shown in FIGS. 1, 2 and 4, form the form fitting hood shown.

It should be noted that not only do parts 14 and 15 fit over the head and shoulders of the wearer but form with parts 16 and 17 a shoulder and chest portion which by its weight particularly when wet fall naturally in place across the chest of the wearer. Any suitable clasp such as clasp 19 formed by male and female parts 20 and 21, respectively, or suitable VELCRO engaging parts may be used to aid in maintaining the shoulder portions 14 and 15 in place particularly when the hood is drying out.

The hood may be made of 100% cotton terry cloth which is double looped for greater cooling surface although any other suitable material may be used and still fall within the scope of this invention. The hood is provided with a suitable edging 22 to render it very durable.

When used the hood may be placed in water to soak up its capacity of water and then worn very damp. After it drys due to evaporation it may again be wet and worn again and the process repeated as much as needed.

Thus, an evaporative cooled hood is provided comprising a pair of arcuate shaped portions one a mirror image of the other which when secured together along a common edge form a cap portion of the hood. These arcuate shaped portions fit over the forehead and down the chest area of the wearer. A pair of tab portions may be provided one secured to a common edge of each of said arcuate shaped portions in the chest area for engaging each other. Clasp means are provided one for each of the engaging tab portions for aiding in holding the tab portions together. A shoulder portion is finally provided which is secured to common edges of each of the arcuate shaped portions and the tab portions thereby forming a unitary hood structure.

Although but one embodiment of the invention has been illustrated and described, it will be apparent to those skilled in the art that various changes and modifications may be made therein without departing from the spirit of the invention or from the scope of the appended claims.

What is claimed is:

1. An evaporative cooled cloth hood worn wet for cooling purposes comprising:

a pair of arcuate shaped portions one a mirror image of the other which when secured together along a common edge form a cap portion of the hood, said arcuate shaped portions fit over the forehead and down over the chest area of the wearer, a pair of tab portions one secured to a common edge of each of said arcuate shaped portions in the chest area for engaging each other, clasp means having a pair of engaging parts one connected to each of said tab portions for aiding in holding said tab portions together; and a shoulder portion secured to common edges of each of said arcuate shaped portions and said tab portions thereby forming a unitary hood assembly, said pair of arcuate shaped portions, said pair of tab portions and said shoulder portion being formed of 100% cotton terry cloth.

2. The evaporative cooled cloth hood set forth in claim 1 wherein:

said pair of arcuate shaped portions, said pair of tab portions and said shoulder portion are secured together by stitching.

* * * * *